US010344622B2

(12) United States Patent
Amadon

(10) Patent No.: US 10,344,622 B2
(45) Date of Patent: Jul. 9, 2019

(54) ASSEMBLY WITH MISTAKE PROOF BAYONETED LUG

(71) Applicant: United Technologies Corporation, Farmington, CT (US)

(72) Inventor: Colin G. Amadon, Keenebunk, ME (US)

(73) Assignee: United Technologies Corporation, Farmington, CT (US)

( * ) Notice: Subject to any disclaimer, the term of this patent is extended or adjusted under 35 U.S.C. 154(b) by 405 days.

(21) Appl. No.: 15/216,802

(22) Filed: Jul. 22, 2016

(65) Prior Publication Data

US 2018/0023420 A1 Jan. 25, 2018

(51) Int. Cl.

| | |
|---|---|
| ***F01D 25/24*** | (2006.01) |
| ***F01D 9/04*** | (2006.01) |
| ***F01D 25/28*** | (2006.01) |
| ***F04D 29/52*** | (2006.01) |
| ***F04D 29/54*** | (2006.01) |
| ***F04D 29/64*** | (2006.01) |

(52) U.S. Cl.

CPC ..... *F01D 25/246* (2013.01); *F01D 9/041* (2013.01); *F01D 25/243* (2013.01); *F01D 25/28* (2013.01); *F04D 29/522* (2013.01); *F04D 29/542* (2013.01); *F04D 29/644* (2013.01); *F05D 2220/30* (2013.01); *F05D 2240/80* (2013.01); *F05D 2260/30* (2013.01); *F05D 2260/31* (2013.01); *F05D 2260/33* (2013.01); *F05D 2260/36* (2013.01)

(58) Field of Classification Search

CPC ..... F01D 25/246; F01D 9/041; F01D 25/243; F01D 25/28; F01D 9/042

See application file for complete search history.

(56) References Cited

U.S. PATENT DOCUMENTS 3,939,651 A * 2/1976 Penny ..... F01D 17/162 60/799
8,579,538 B2 11/2013 Juh et al.
8,662,845 B2 3/2014 Virkler et al.
(Continued)

FOREIGN PATENT DOCUMENTS

FR 2524933 A1 * 10/1983 ..... F01D 5/3015
GB 2434414 A * 7/2007 ..... F01D 9/042
WO WO2016057010 A1 4/2016

OTHER PUBLICATIONS

EP search report for EP17181736.4 dated Nov. 23, 2017.

*Primary Examiner* — Justin D Seabe
*Assistant Examiner* — Sabbir Hasan
(74) *Attorney, Agent, or Firm* — O'Shea Getz P.C.

(57) ABSTRACT

An assembly for rotational equipment with an axial centerline. The assembly includes a first component and a second component. Each of the components extends circumferentially around and axially along the centerline. The first component includes a flange and a lug aperture extending axially through the flange. The second component includes a mount base and a bayoneted lug on the mount base. The mount base is configured to axially engage the flange where the bayoneted lug extends through the lug aperture. A fastener secures the components together. The fastener projects axially into a fastener aperture in the mount base for an axial length that is less than or equal to an axial length of the bayoneted lug.

19 Claims, 9 Drawing Sheets

(56) References Cited

U.S. PATENT DOCUMENTS

| | | | | |
|---|---|---|---|---|
| 8,757,966 | B2 * | 6/2014 | Blanchard | F01D 9/042 415/190 |
| 8,800,133 | B2 | 8/2014 | Caprario et al. | |
| 8,840,375 | B2 | 9/2014 | Virkler | |
| 8,961,141 | B2 | 2/2015 | Anderson et al. | |
| 9,212,562 | B2 | 12/2015 | Burt et al. | |
| 9,327,368 | B2 | 5/2016 | Hagan | |
| 9,371,863 | B2 | 6/2016 | Juh et al. | |
| 2009/0022593 | A1 | 1/2009 | Oka | |
| 2014/0010648 | A1 | 1/2014 | Muldoon | |

* cited by examiner

ASSEMBLY WITH MISTAKE PROOF BAYONETED LUG

BACKGROUND OF THE INVENTION

1. Technical Field

This disclosure relates generally to rotational equipment and, more particularly, to mounting components together in a substantially error/mistake proof manner.

2. Background Information

A gas turbine engine may include a vane array mounted to an adjacent static structure within the engine. Various methods and arrangements for mounting such a vane array to a static structure are known in the art. While these mounting methods and arrangements have various benefits, there is still room in the art for improvement.

SUMMARY OF THE DISCLOSURE

According to an aspect of the present disclosure, an assembly is provided for rotational equipment with an axial centerline. This assembly includes a plurality of components including a first component and a second component. Each of the components extends circumferentially around and axially along the centerline. The first component includes a flange and a lug aperture extending axially through the flange. The second component includes a mount base and a bayoneted lug on the mount base. The mount base is configured to axially engage the flange where the bayoneted lug extends through the lug aperture. A fastener secures the components together. The fastener projects axially into a fastener aperture in the mount base for an axial length that is less than or equal to an axial length of the bayoneted lug.

According to another aspect of the present disclosure, an assembly is provided for rotational equipment with an axial centerline. This assembly includes an annular first component, an annular second component and a fastener. The first component includes a flange and a lug aperture extending axially through the flange. The second component includes a mount base and a bayoneted lug on the mount base. The mount base is configured to axially engage the flange where the bayoneted lug extends through the lug aperture. The fastener secures the components together. The fastener projects axially into a fastener aperture in the mount base. The bayoneted lug is configured to prevent mating of the fastener with the fastener aperture where the bayoneted lug is axially between the flange and the mount base.

According to still another aspect of the present disclosure, an assembly is provided for a turbine engine with an axial centerline. This assembly includes a vane array, a static structure and a fastener securing the vane array and the static structure together. The vane array includes a flange and a lug aperture extending axially through the flange. The static structure includes a mount base and a bayoneted lug on the mount base. The mount base is configured to axially engage the flange where the bayoneted lug extends through the lug aperture. The fastener projects axially into a fastener aperture in the mount base. The bayoneted lug is configured to prevent mating of the fastener with the fastener aperture where the bayoneted lug is axially between the flange and the mount base.

The vane array may include an inner platform. The flange may be connected to and radially within the inner platform.

The axial length that the fastener projects into the fastener aperture may be less than the axial length of the bayoneted lug.

The bayoneted lug may include a lug base and a lug bayonet. The lug base may project axially out from the mount base. The lug bayonet may project laterally out from the lug base. The flange may be configured to be received within a channel axially between the lug bayonet and the mount base.

The lug bayonet may laterally overlap a portion of the mount base that a corresponding portion of the flange axially engages.

A channel may extend laterally into and radially through the bayoneted lug. The flange may be configured to be received within the channel where the flange axially engages the mount base.

The first component may include a second flange radially outboard of the flange. The second component may include a second mount radially outboard of the bayoneted lug. The second flange may be configured to be received within a second channel within the second mount where the flange is received within the channel.

The bayoneted lug may be configured to prevent mating of the fastener with the fastener aperture where the bayoneted lug is axially between the flange and the mount base.

The rotational equipment may be a turbine engine. A first one of the components may include a vane array for the turbine engine. A second one of the components may include a case, support structure, etc. for the turbine engine.

The first one of the components may be configured as or otherwise include the first component. The second one of the components may be configured as or otherwise include the second component.

The first one of the components may include a first inner platform. The flange may be connected to and may be radially within the first inner platform. The second one of the components may include a second inner platform. The mount base may be connected to and may be radially within the second inner platform.

The second one of the components may include an outer platform and an array of stator vanes extending radially between the second inner platform and the outer platform.

The fastener may project axially into the fastener aperture for an axial length that is less than or equal to an axial length of the bayoneted lug.

The foregoing features and the operation of the invention will become more apparent in light of the following description and the accompanying drawings.

DETAILED DESCRIPTION OF THE INVENTION

Figure 1:
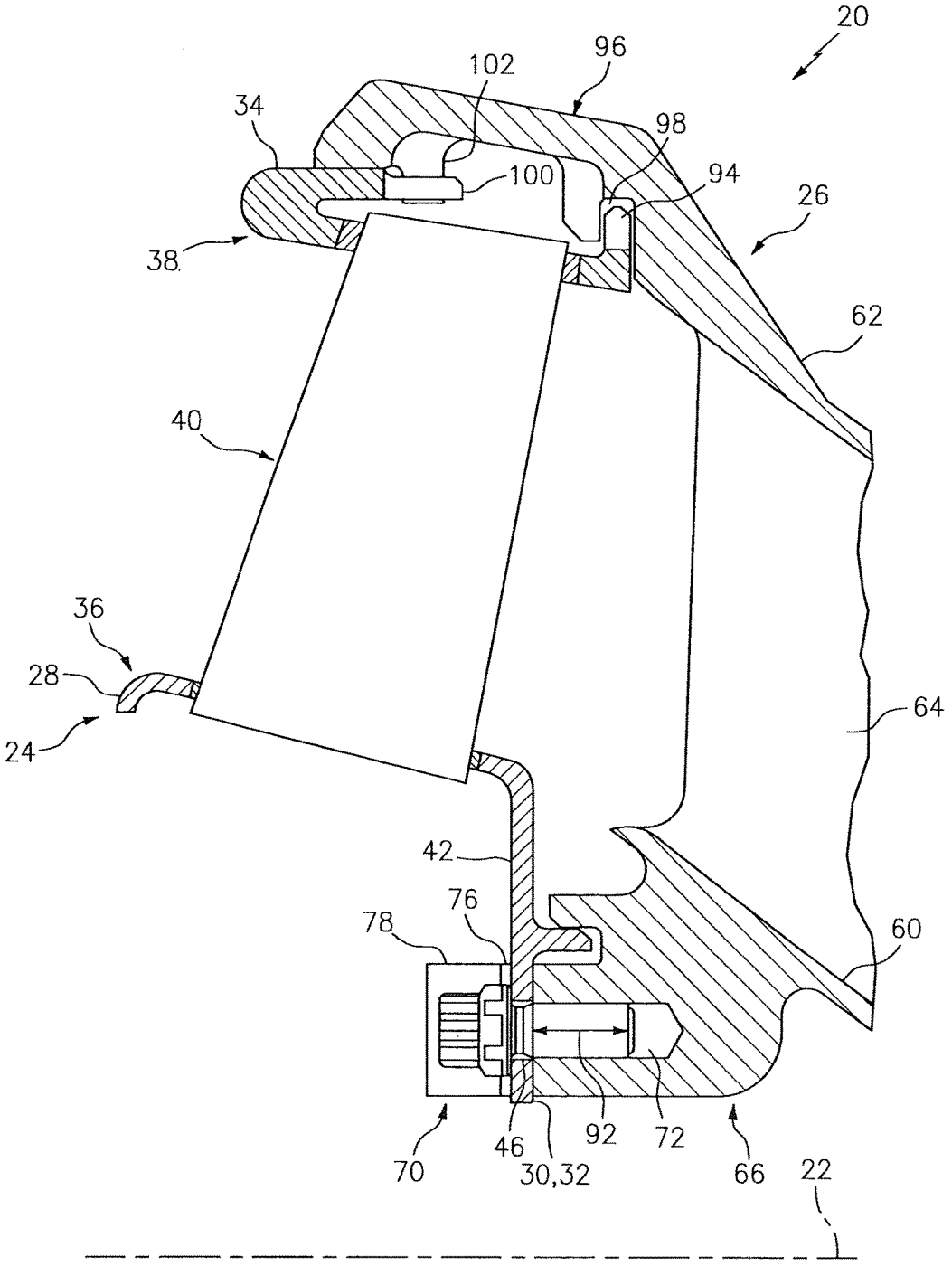
FIG. 1 is a partial, side sectional illustration of an assembly for a gas turbine engine.

FIG. 1 illustrates an assembly 20 for a gas turbine engine with an axial centerline 22. The turbine engine assembly 20 includes a vane array 24 and another static structure 26. This other static structure 26 may be configured as a turbine engine case, a support structure, a mid-compressor frame and/or any other static component for the turbine engine.

The vane array 24 is configured as an annular body. The vane array 24 extends axially along the centerline 22 between an array upstream end 28 and an array downstream end 30. The vane array 24 extends radially between an array inner side 32 and an array outer side 34. The vane array 24 extends circumferentially around the centerline 22 as shown in FIG. 2.

Figure 2:
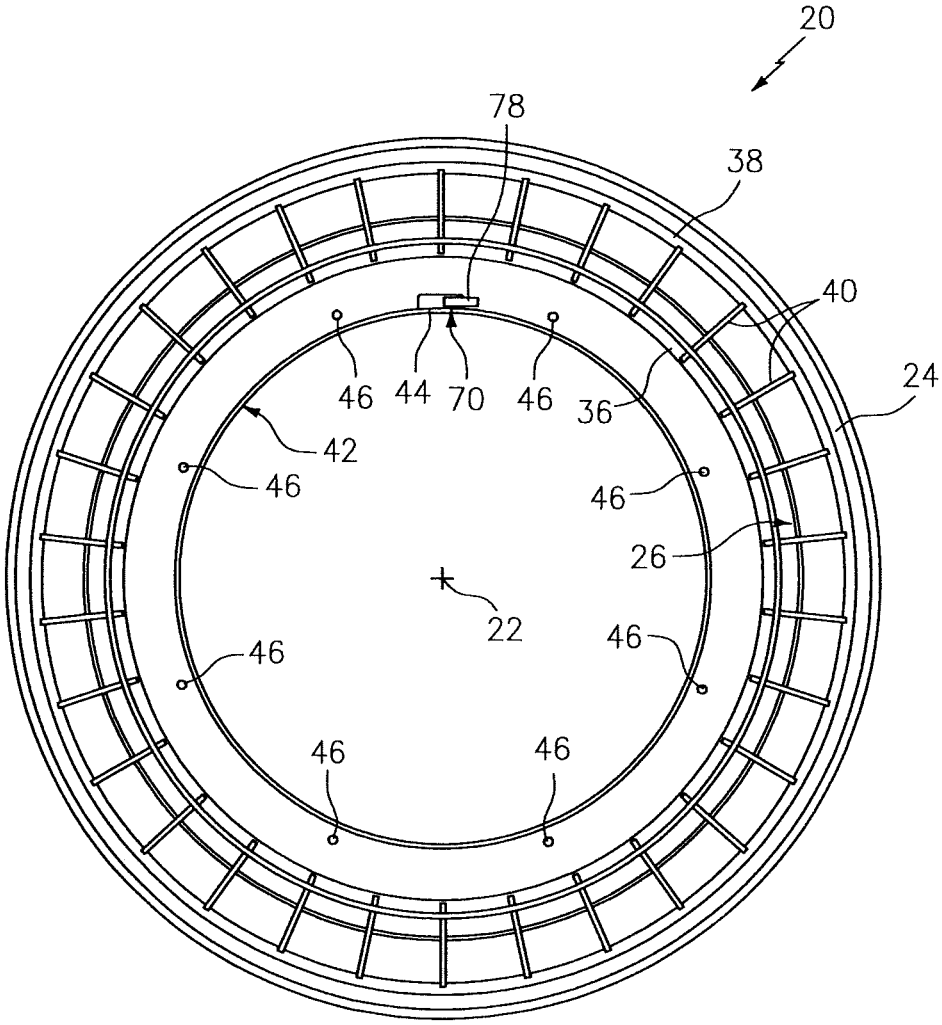
FIG. 2 is a front end view of the assembly of FIG. 1.

The vane array 24 of FIGS. 1 and 2 includes a tubular inner platform 36, a tubular outer platform 38 and a plurality of vanes 40. The vanes 40 are arranged in an annular array about the centerline 22. Each of the vanes 40 is connected to and extends radially between the inner platform 36 and the outer platform.

Figure 3:
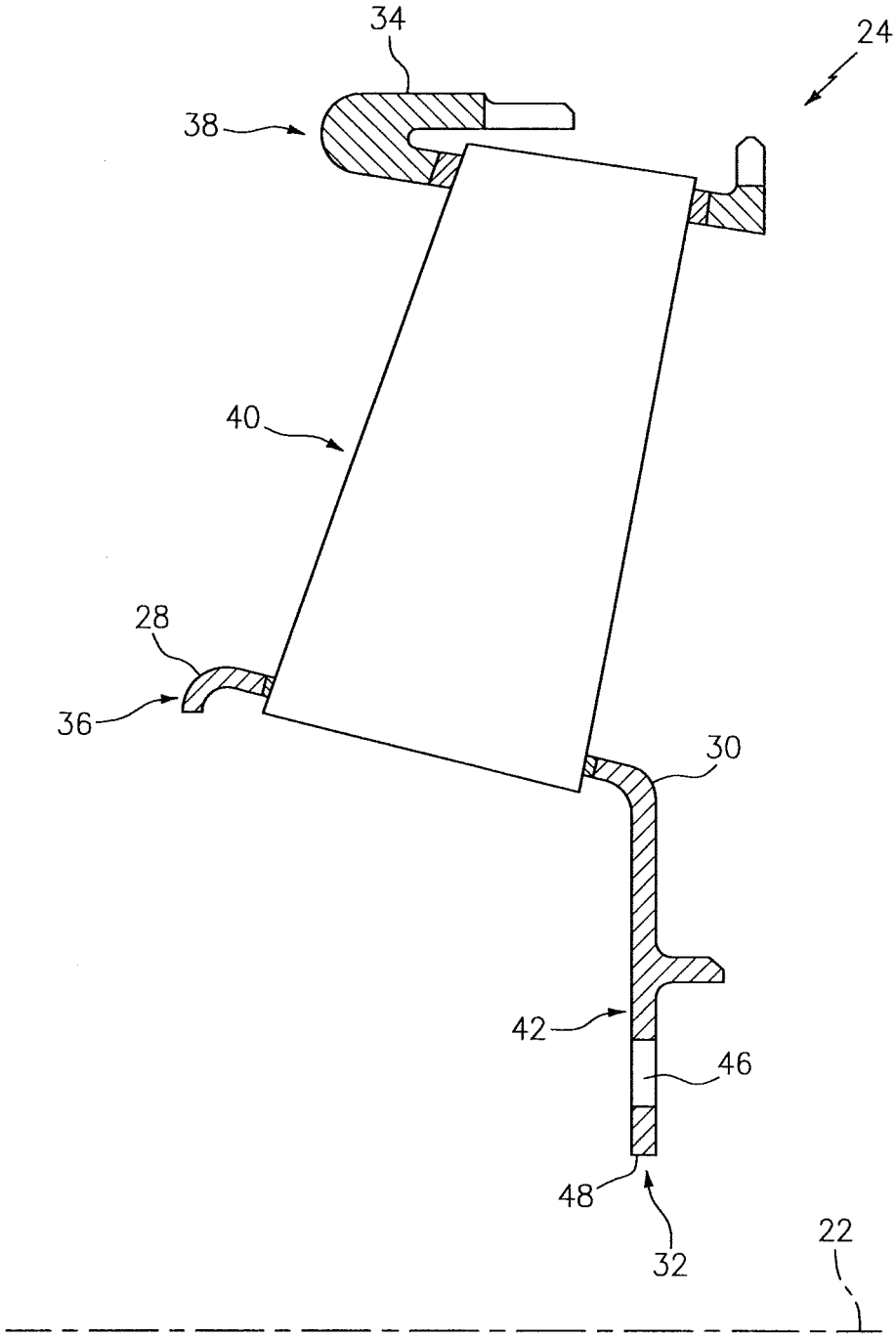
FIG. 3 is a partial, side sectional illustration of a vane array for the assembly of FIG. 1.

Referring to FIG. 3, the vane array 24 also includes at least one flange 42, at least one lug aperture 44 (see FIG. 4) and one or more fastener apertures 46. The flange 42 may be configured with a generally full-hoop body; see also FIG. 2. The flange 42 is connected to and disposed radially within the inner platform 36 at (e.g., on, adjacent or proximate) the array downstream end 30. The flange 42 projects radially inward from the inner platform 36 to a distal inner flange end 48.

Figure 4:
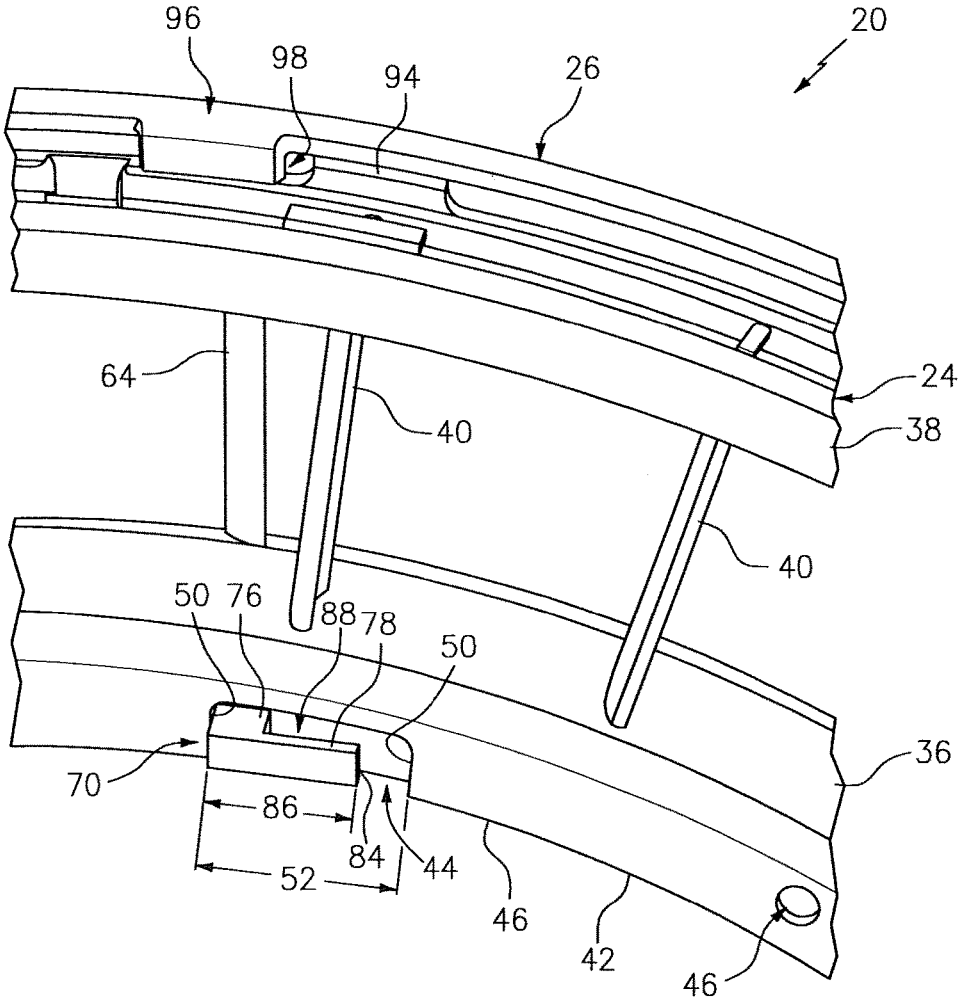
FIG. 4 is a partial, perspective illustration of the assembly of FIG. 1.

Referring to FIG. 4, the lug aperture 44 extends axially through the flange 42. The lug aperture 44 extends radially into the flange 42 from the inner flange end 48. The lug aperture 44 extends laterally (e.g., circumferentially or tangentially) within the flange 42 between opposing lug aperture ends 50, which provides the lug apertures with a lateral width 52.

Referring to FIG. 2, the fastener apertures 46 are arranged in an annular array about the centerline 22. Each of the fastener apertures 46 extends axially through the flange 42.

Figure 5:
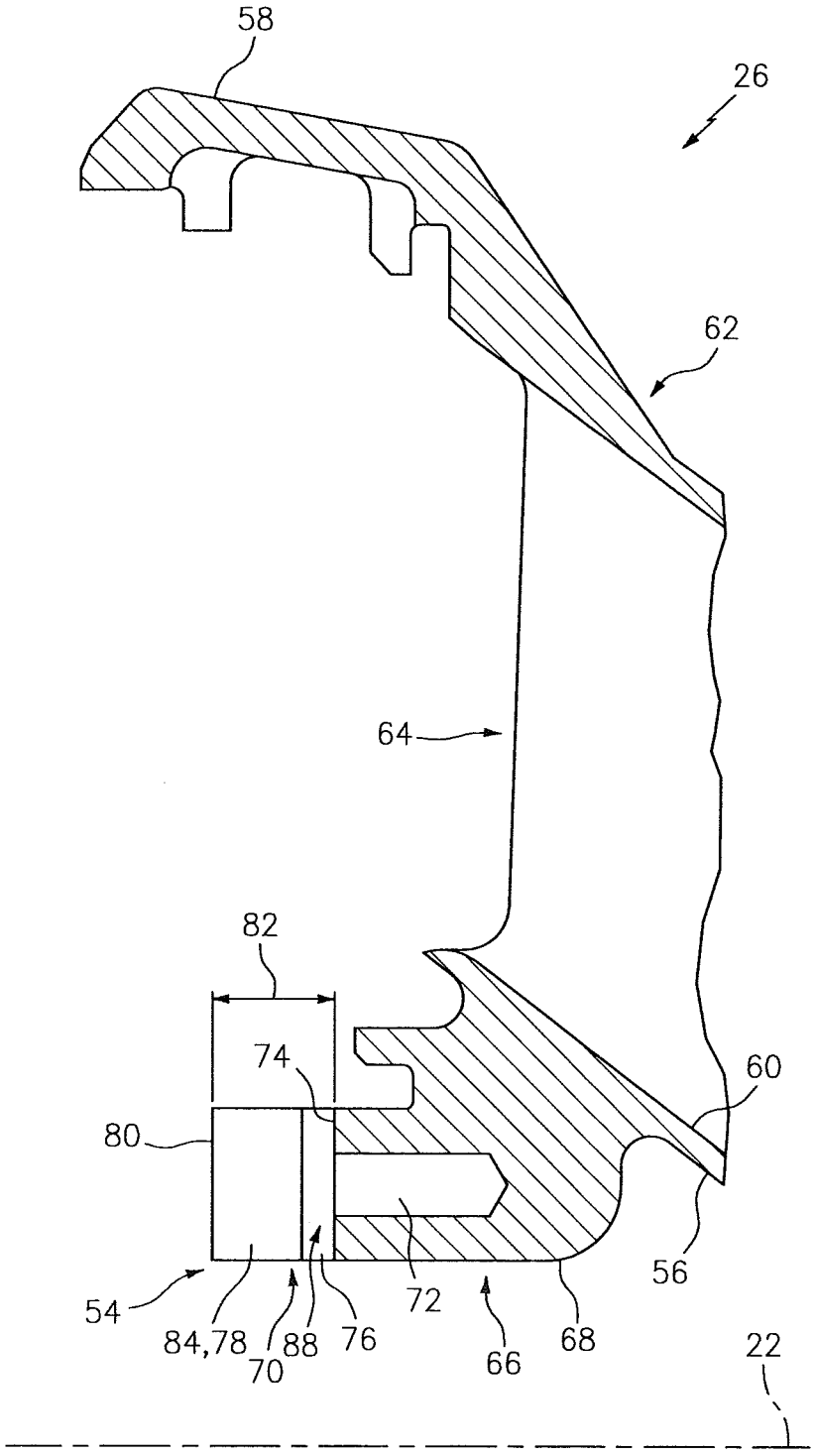
FIG. 5 is a partial, side sectional illustration of a static structure for the assembly of FIG. 1.

Referring to FIG. 5, the static structure 26 is configured as an annular body. The static structure 26 extends axially along the centerline 22 to a structure upstream end 54. The static structure 26 extends radially between a structure inner side 56 and a structure outer side 58. The static structure 26 extends circumferentially around the centerline 22 as shown in FIG. 2.

The static structure 26 of FIGS. 2 and 5 includes a tubular inner platform 60, a tubular outer platform 62 and a plurality of supports 64. The supports 64 are arranged in an annular array about the centerline 22. Each of the supports 64 is connected to and extends radially between the inner platform 60 and the outer platform 62.

Referring to FIG. 5, the static structure 26 also includes an inner mount 66. This inner mount 66 includes at least one mount base 68, at least one bayoneted lug 70 and one or more fastener apertures 72. The mount base 68 may be configured with a generally full-hoop body, or a scalloped body. The mount base 68 is connected to and disposed radially within the inner platform 60 at the structure upstream end 54. The mount base 68 projects radially inward from the inner platform 60 to a distal inner mount end 74.

Referring to FIGS. 4 and 5, the bayoneted lug 70 is on and connected to the mount base 68. The bayoneted lug 70 includes a lug base 76 and a lug bayonet 78. The lug base 76 is connected to and projects axially out from (e.g., in an upstream direction) the mount base 68 to a distal axial lug end 80, which provides the bayoneted lug 70 with an axial length 82 (see FIG. 5). The lug bayonet 78 is connected to and projects laterally out from the lug base 76 to a distal bayonet end 84, which provides the bayoneted lug 70 with a lateral width 86 (see FIG. 4) that is less than (or substantially equal to) the lateral width 52 of the lug aperture 44.

Figure 6:
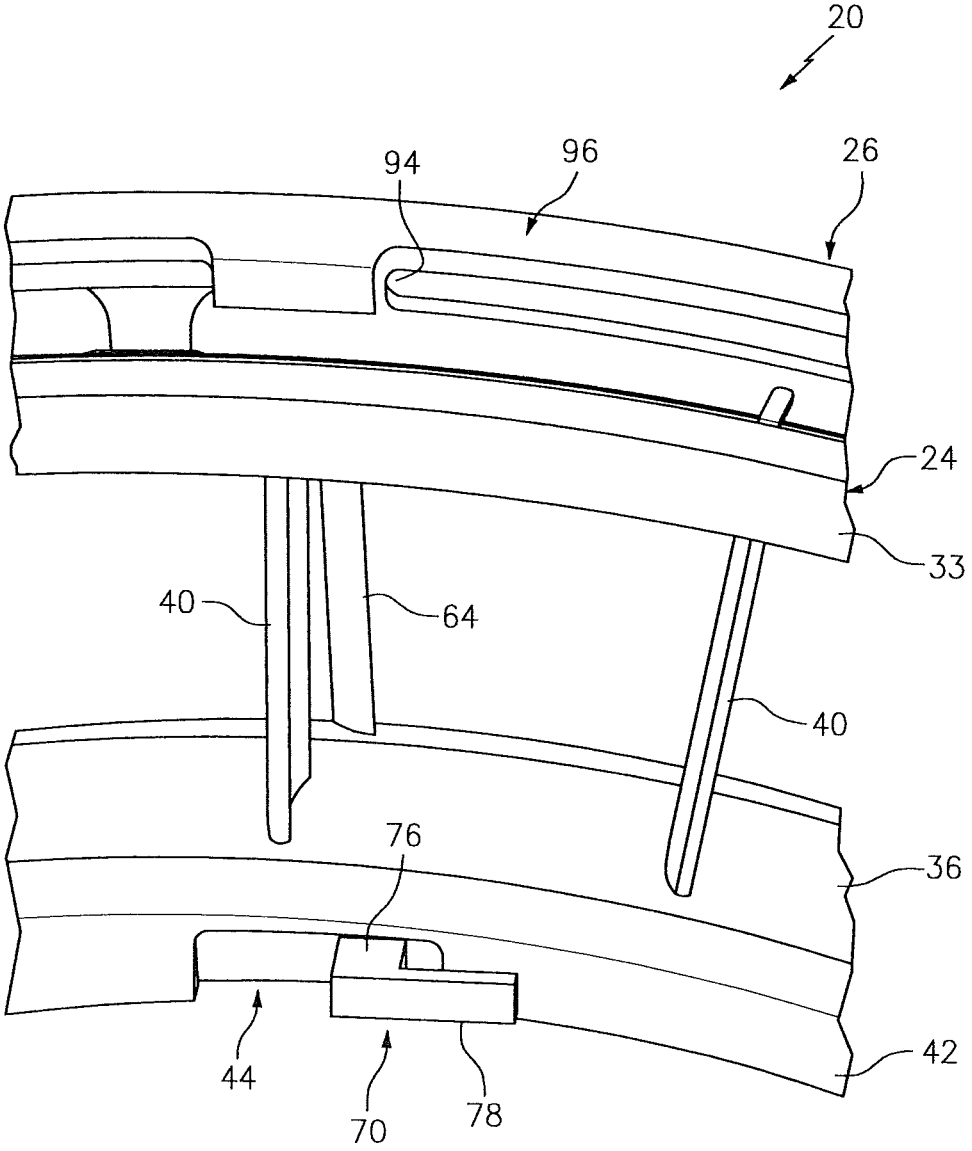
FIG. 6 is another partial, perspective illustration of the assembly of FIG. 1.

A flange channel 88 extends laterally into the bayoneted lug 70 from the bayonet end 84. The flange channel 88 extends radially through the bayoneted lug 70. The flange channel 88 extends axially between the lug bayonet 78 and the mount base 68, laterally adjacent the lug base 76. The flange channel 88 is configured to receive a portion of the flange 42 as shown in FIG. 6.

Referring to FIG. 5, the fastener apertures 72 are arranged in an annular array about the centerline 22. Each of the fastener apertures 72 extends axially through the flange 42.

Figure 7:
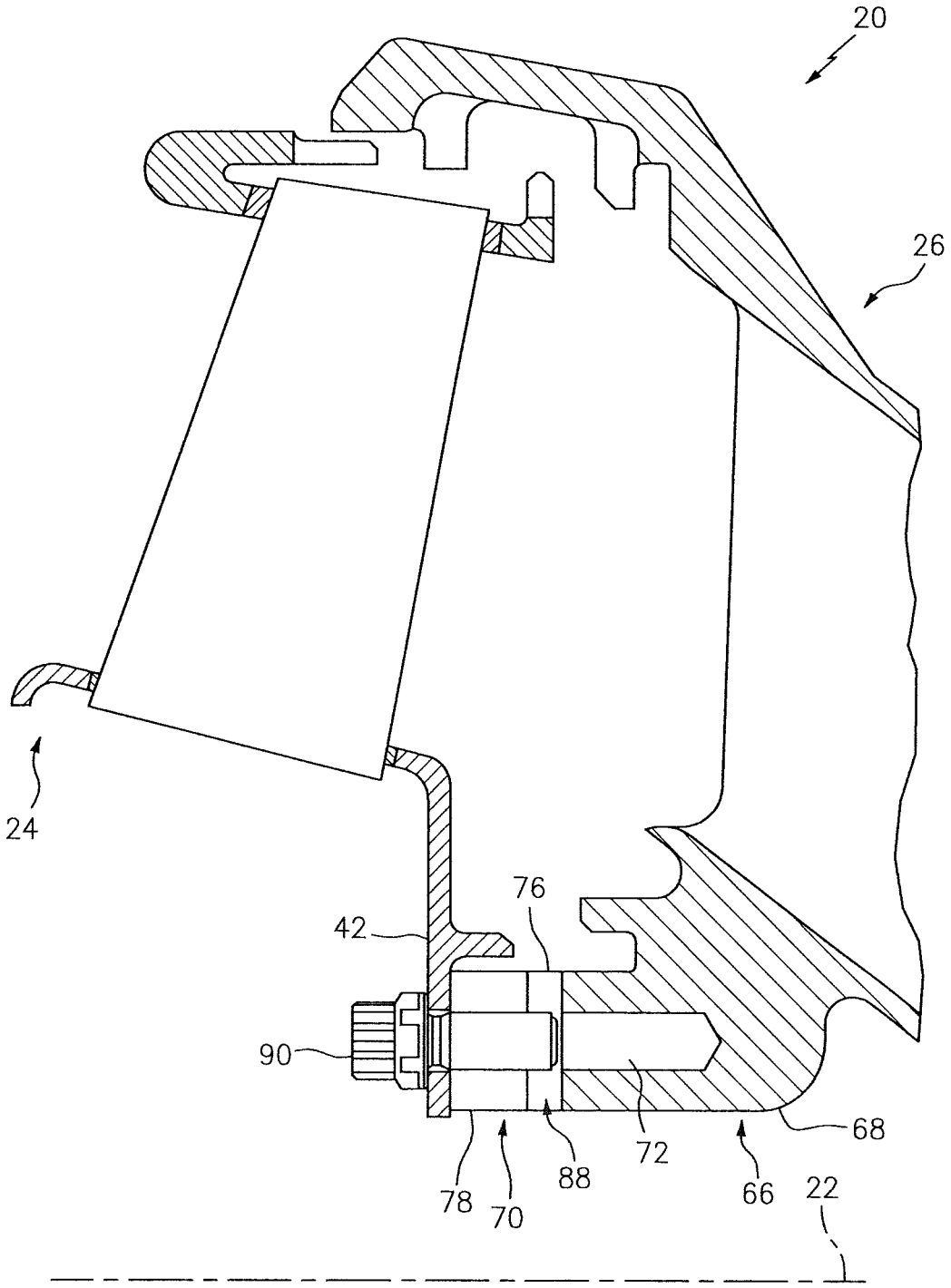
FIG. 7 is a partial, side sectional illustration of the assembly of FIG. 1 before being assembled.

During assembly of the turbine engine components 24 and 26, the vane array 24 is positioned axially next to the static structure 26 as generally shown in FIG. 7. The vane array 24 is clocked about the centerline 22 such that the bayoneted lug 70 is circumferentially aligned with the lug aperture 44 as shown in FIG. 4. Once the bayoneted lug 70 is aligned with the lug aperture 44, the vane array 24 is moved axially along the centerline 22 towards the static structure 26 such that the lug bayonet 78 passes axially through the lug aperture 44 until the flange 42 is axially next to or axially engaging (e.g., contacting) the inner mount 66; e.g., see engagement shown in FIG. 1. The vane array 24 is subsequently clocked about the centerline 22 such that the portion of the flange 42 moves into the flange channel 88 as shown in FIG. 6. Referring now to FIG. 1, a plurality of fasteners 90 (e.g., bolts) are subsequently mated respectively with the fastener apertures 46, 72. Each fastener 90 extends axially through a respective one of the fastener apertures 46 and projects axially into a respective one of the fastener apertures 72 for an axial length 92.

Figure 8:
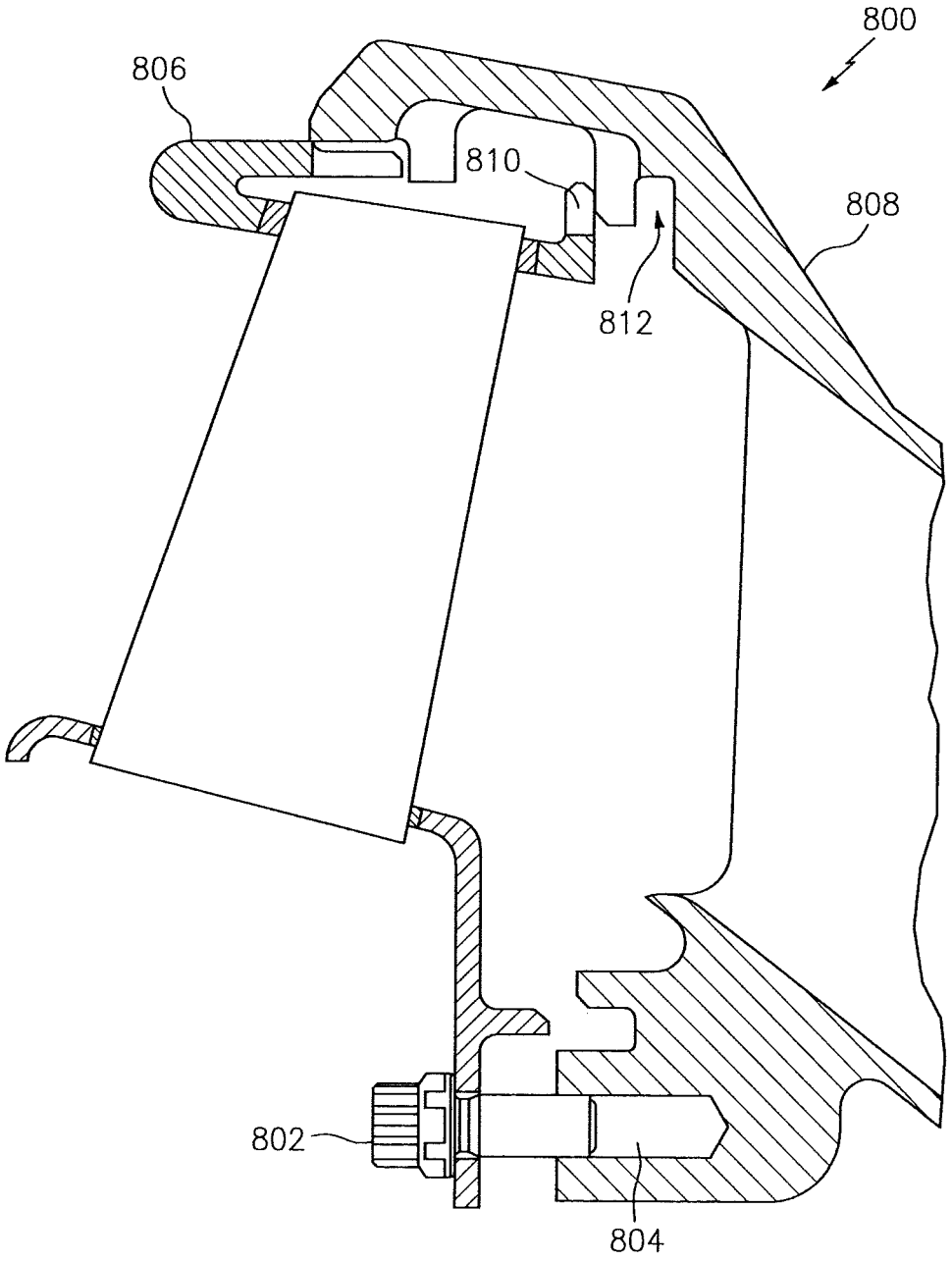
FIG. 8 (PRIOR ART)
FIG. 8 is a partial, side sectional illustration of a prior art assembly for a gas turbine engine.

Each fastener 90 is sized such that its axial length 92 is less than (or substantially equal to) the axial length 82 of the bayoneted lug 70 (see FIG. 5). In this manner, the fasteners 90 cannot be mated with (threaded into) the fastener apertures 72 until after the flange 42 is seated within the flange channel 88. For example, where the fastener apertures 46, 72 are aligned but the bayoneted lug 70 is axially between the flange 42 and the mount base 68 as shown in FIG. 7, the fasteners 90 are not long enough to be mated with the fastener apertures 72. The bayoneted lug 70 therefore is configured and operable to prevent mounting of the vane array 24 to the static structure 26 where those components 24, 26 are not mated as designed. This is in contrast to the prior art arrangement 800 shown in FIG. 8, where bolts 802 can be threaded into corresponding bolt holes 804 even where outer platforms 806 and 808 are not properly aligned; e.g., lugs 810 are not within corresponding channels 812.

In some embodiments of the present disclosure, referring to FIGS. 1, 4 and 6, the vane array 24 may include one or more outer flanges 94 (e.g., tabs or lugs) and the static structure 26 may include an outer mount 96. The outer flanges 94 are arranged in an annular array about the centerline 22, and configured to mate with corresponding channels 98 within the outer mount 96. In this arrangement, the outer flanges 94 are configured to axially secure and locate the outer platform 38 with the outer platform 62.

Referring to FIG. 1, the vane array 24 may also include one or more circumferential locators 100 (e.g., tabs or lugs), which laterally engage one or more corresponding circumferential locators 102 (e.g., tabs or lugs) of the outer mount 96. The lateral engagement between the locators 100, 102 operate to generally circumferentially secure and locate (in one rotational direction) the outer platform 38 with the outer platform 62.

In some embodiments, the vane array 24 may include more than one lug aperture 44. Similarly, the static structure 26 may include more than one bayoneted lug 70 that mate with the lug apertures 44 in the manner described above. In such embodiments, the lug apertures 44 and the bayoneted lugs 70 may be arranged in respective arrays about the centerline 22.

In some embodiments, the mounting arrangements associated with the inner and the outer platforms may be at least radially reversed. For example, in some embodiments, the bayoneted lug 70 and its mount 66 are connected to the outer platform 62. The flange 42 correspondingly is connected to the outer platform 38.

In some embodiments, the mounting arrangements associated with the inner and the outer platforms may be at least axially reversed. For example, in some embodiments, the bayoneted lug 70 and its mount 66 are connected to the inner platform 36. The flange 42 correspondingly is connected to the inner platform 60.

In some embodiments, the flange 42 may alternatively be scalloped. In other embodiments, the flange 42 may be one of a plurality of flanges (e.g., tabs) arranged in an annular array.

In some embodiments, one or more of the vanes 40 may be attached to the platforms 36 and 38 using potting material. Of course, the vanes 40 may also or alternatively be attached to the platform(s) 36, 38 using other techniques. In still other embodiments, the vanes 40 may be formed integral (e.g., cast, etc.) with one or both platforms 36 and 38.

In some embodiments, the vane array 24 may be a segmented body. However, the present disclosure is not limited to such a segmented configuration.

The mounting arrangements disclosed above are described with respect to mounting the vane array 24 to the static structure 26. However, the same or similar mounting arrangements may also or alternatively be used to mount other types and configurations of turbine engine components together. Furthermore, it is also contemplated that the same or similar mounting arrangements may also or alternatively be used to mount non-turbine engine components together. The present disclosure therefore is not limited to gas turbine engine applications. The mounting arrangements disclosed above, for example, may alternatively be used to mount components of a wind turbine, a water turbine, a rotary engine, a vehicle drivetrain or any other type of rotational equipment.

Figure 9:
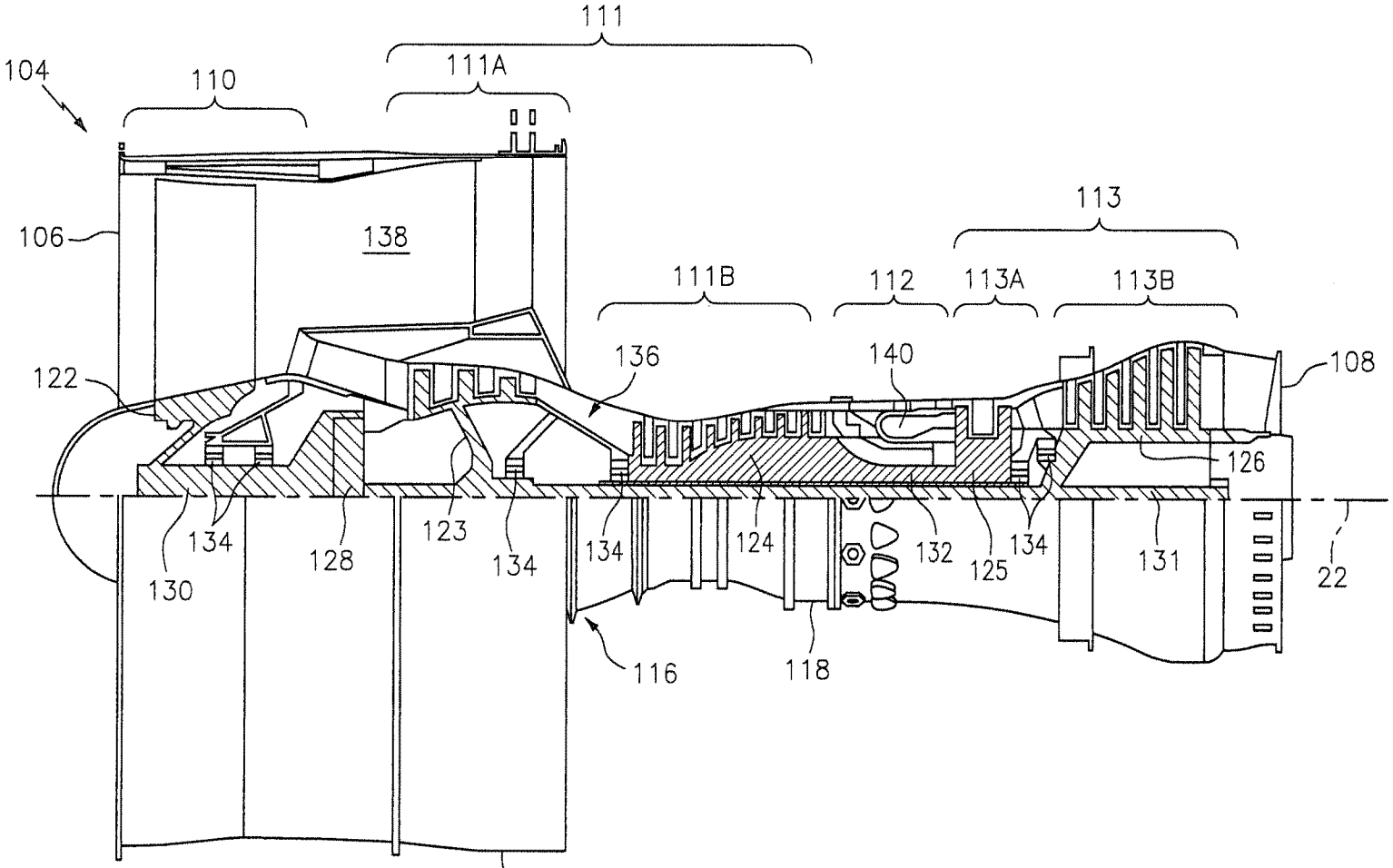
FIG. 9 is a side cutaway illustration of a gas turbine engine.

FIG. 9 is a side cutaway illustration of an exemplary geared turbine engine 104 in which the turbine engine assembly 20 may be configured. The turbine engine 104 of FIG. 9 extends along the centerline 22 between an upstream airflow inlet 106 and a downstream airflow exhaust 108. The turbine engine 104 includes a fan section 110, a compressor section 111, a combustor section 112 and a turbine section 113. The compressor section 111 includes a low pressure compressor (LPC) section 111A and a high pressure compressor (HPC) section 111B. The turbine section 113 includes a high pressure turbine (HPT) section 113A and a low pressure turbine (LPT) section 113B.

The engine sections 110, 111A, 111B, 112, 113A and 113B are arranged sequentially along the centerline 22 within an engine housing 116. This housing 116 includes an inner case 118 (e.g., a core case) and an outer case 120 (e.g., a fan case). The inner case 118 may house one or more of the engine sections 111-113; e.g., an engine core. The outer case 120 may house at least the fan section 110.

Each of the engine sections 110, 111A, 111B, 113A and 113B includes a respective rotor 122-126. Each of these rotors 122-126 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 122 is connected to a gear train 128, for example, through a fan shaft 130. The gear train 128 and the LPC rotor 123 are connected to and driven by the LPT rotor 126 through a low speed shaft 131. The HPC rotor 124 is connected to and driven by the HPT rotor 125 through a high speed shaft 132. The shafts 130-132 are rotatably supported by a plurality of bearings 134; e.g., rolling element and/or thrust bearings. Each of these bearings 134 is connected to the engine housing 116 by at least one stationary structure such as, for example, an annular support strut.

During operation, air enters the turbine engine 104 through the airflow inlet 106. This air is directed through the fan section 110 and into a core gas path 136 and a bypass gas path 138. The core gas path 136 extends sequentially through the engine sections and, thus, the turbine engine assembly 20. The bypass gas path 138 extends away from the fan section 110 through a bypass duct, which circumscribes and bypasses the engine core. The air within the core gas path 136 may be referred to as "core air". The air within the bypass gas path 138 may be referred to as "bypass air".

The core air is compressed by the compressor rotors 123 and 124 and directed into a combustion chamber 140 of a combustor in the combustor section 112. Fuel is injected into the combustion chamber 140 and mixed with the compressed core air to provide a fuel-air mixture. This fuel air mixture is ignited and combustion products thereof flow through and sequentially cause the turbine rotors 125 and 126 to rotate. The rotation of the turbine rotors 125 and 126 respectively drive rotation of the compressor rotors 124 and 123 and, thus, compression of the air received from a core airflow inlet. The rotation of the turbine rotor 126 also drives rotation of the fan rotor 122, which propels bypass air through and out of the bypass gas path 138. The propulsion of the bypass air may account for a majority of thrust generated by the turbine engine 104, e.g., more than seventy-five percent (75%) of engine thrust. The turbine engine 104 of the present disclosure, however, is not limited to the foregoing exemplary thrust ratio.

The turbine engine assembly 20 may be included in various aircraft and industrial turbine engines other than the one described above as well as in other types of equipment. The turbine engine assembly 20, for example, may be included in a geared turbine engine where a gear train connects one or more shafts to one or more rotors in a fan section, a compressor section and/or any other engine section. Alternatively, the turbine engine assembly 20 may be included in a turbine engine configured without a gear train. The turbine engine assembly 20 may be included in a geared or non-geared turbine engine configured with a single spool, with two spools (e.g., see FIG. 9), or with more than two spools. The turbine engine may be configured as a turbofan engine, a turbojet engine, a propfan engine, a pusher fan engine or any other type of turbine engine. The present disclosure therefore is not limited to any particular types or configurations of turbine engine. Furthermore, as mentioned above, the assembly 20 of the present disclosure may also be utilized for non-turbine engine applications.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. An assembly for rotational equipment with an axial centerline, comprising:

a plurality of components including a first component and a second component, each of the components extending circumferentially around and axially along the centerline;

the first component including a flange and a lug aperture extending axially through the flange;

the second component including a mount base and a bayoneted lug on the mount base, and the mount base configured to axially engage the flange where the bayoneted lug extends through the lug aperture; and a fastener securing the plurality of components together, the fastener projecting axially into a fastener aperture in the mount base for an axial length that is less than or equal to an axial length of the bayoneted lug.

2. The assembly of claim 1, wherein the axial length that the fastener projects into the fastener aperture is less than the axial length of the bayoneted lug.

3. The assembly of claim 1, wherein the bayoneted lug comprises a lug base and a lug bayonet;

the lug base projects axially out from the mount base;

the lug bayonet projects laterally out from the lug base; and the flange is configured to be received within a channel axially between the lug bayonet and the mount base.

4. The assembly of claim 3, wherein the lug bayonet laterally overlaps a portion of the mount base that a corresponding portion of the flange axially engages.

5. The assembly of claim 1, wherein a channel extends laterally into and radially through the bayoneted lug, and the flange is configured to be received within the channel where the flange axially engages the mount base.

6. The assembly of claim 5, wherein the first component further includes a second flange radially outboard of the flange;

the second component further includes a second mount radially outboard of the bayoneted lug; and the second flange is configured to be received within a second channel within the second mount where the flange is received within the channel.

7. The assembly of claim 1, wherein the bayoneted lug is configured to prevent mating of the fastener with the fastener aperture when the bayoneted lug is axially between the flange and the mount base.

8. The assembly of claim 1, wherein the rotational equipment is a turbine engine;

a first one of the plurality of components comprises a vane array for the turbine engine; and a second one of the plurality of components comprises a case for the turbine engine.

9. The assembly of claim 8, wherein the first one of the plurality of components comprises the first component, and the second one of the plurality of components comprises the second component.

10. The assembly of claim 8, wherein the first one of the plurality of components further includes a first inner platform, and the flange is connected to and is radially within the first inner platform; and the second one of the plurality of components further includes a second inner platform, and the mount base is connected to and is radially within the second inner platform.

11. The assembly of claim 10, wherein the second one of the plurality of components further includes an outer platform and an array of stator vanes extending radially between the second inner platform and the outer platform.

12. An assembly for rotational equipment with an axial centerline, comprising:

an annular first component including a flange and a lug aperture extending axially through the flange;

an annular second component including a mount base and a bayoneted lug on the mount base, the mount base configured to axially engage the flange where the bayoneted lug extends through the lug aperture; and a fastener securing the plurality of components together, the fastener projecting axially into a fastener aperture in the mount base;

wherein the bayoneted lug is configured to prevent mating of the fastener with the fastener aperture when the bayoneted lug is axially between the flange and the mount base;

wherein the rotational equipment is a turbine engine;

wherein the first component comprises a vane array for the turbine engine; and wherein the second component comprises a support structure for the turbine engine.

13. The assembly of claim 12, wherein the fastener projects axially into the fastener aperture for an axial length that is less than or equal to an axial length of the bayoneted lug.

14. The assembly of claim 12, wherein the bayoneted lug comprises a lug base and a lug bayonet;

the lug base projects axially out from the mount base;

the lug bayonet projects laterally out from the lug base; and the flange is configured to be received within a channel axially between the lug bayonet and the mount base.

15. The assembly of claim 14, wherein the lug bayonet laterally overlaps a portion of the mount base that a corresponding portion of the flange axially engages.

16. The assembly of claim 12, wherein a channel extends laterally into and radially through the bayoneted lug, and the flange is configured to be received within the channel where the flange axially engages the mount base.

17. The assembly of claim 16, wherein the first component further includes a second flange radially outboard of the flange;

the second component further includes a second mount radially outboard of the bayoneted lug; and the second flange is configured to be received within a second channel within the second mount where the flange is received within the channel.

18. An assembly for a turbine engine with an axial centerline, comprising:

a vane array including a flange and a lug aperture extending axially through the flange;

a static structure including a mount base and a bayoneted lug on the mount base, the mount base configured to axially engage the flange where the bayoneted lug extends through the lug aperture; and a fastener securing the vane array and the static structure together, the fastener projecting axially into a fastener aperture in the mount base;

wherein the bayoneted lug is configured to prevent mating of the fastener with the fastener aperture when the bayoneted lug is axially between the flange and the mount base.

19. The assembly of claim 18, wherein the vane array further includes an inner platform, and the flange is connected to and radially within the inner platform.

* * * * *